US009281625B2

(12) United States Patent
Kao et al.

(10) Patent No.: US 9,281,625 B2
(45) Date of Patent: Mar. 8, 2016

(54) ELECTRICAL CONNECTOR HAVING TERMINAL PORTIONS IN SPECIFIC ARRANGEMENT AND A GROUNDING PLATE FOR EXCELLENT HIGH-FREQUENCY CHARACTERISTICS

(71) Applicant: HON HAI PRECISION INDUSTRY CO., LTD., New Taipei (TW)

(72) Inventors: Chien-Ping Kao, Hershey, PA (US); Terrance F. Little, Fullerton, CA (US); An-Jen Yang, Irvine, CA (US); Duong Phan, Westminister, CA (US); Kuo-Chun Hsu, New Taipei (TW); Ming-Chuan Wu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/242,835

(22) Filed: Apr. 1, 2014

(65) Prior Publication Data

US 2014/0206233 A1 Jul. 24, 2014

Related U.S. Application Data

(63) Continuation of application No. 13/479,289, filed on May 24, 2012, now Pat. No. 8,684,769.

(51) Int. Cl.
*H01R 13/648* (2006.01)
*H01R 13/658* (2011.01)
(Continued)

(52) U.S. Cl.
CPC ..... *H01R 13/658* (2013.01); *H01R 13/6471* (2013.01); *H01R 13/6585* (2013.01); *H01R 43/20* (2013.01); *H01R 13/648* (2013.01); *H01R 13/6594* (2013.01); *Y10T 29/49208* (2015.01)

(58) Field of Classification Search
CPC .... H01R 13/648; H01R 13/658; H01R 13/74; H01R 23/6873; H01R 23/7073
USPC ..... 439/607.28, 607.4, 607.41, 218
See application file for complete search history.

(56) References Cited

U.S. PATENT DOCUMENTS 6,319,061 B1 * 11/2001 Chen et al. ..... 439/607.15
6,447,311 B1 * 9/2002 Hu et al. ..... 439/108
(Continued)

FOREIGN PATENT DOCUMENTS

CN 2422734 Y 3/2001
CN 200965950 Y 1/2007
CN 101016229 A 1/2008

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A receptacle electrical connector includes a metallic shell, an insulating bracket defining a receiving cavity, an upper member including a base portion and a mating portion and a lower insulating member distinct from and assembled with the base portion. The upper member is loaded with upper contacts with contacting portions arranged on an upper surface of the mating portion and a shielding plate is located between the upper and lower surface of the upper member. The lower member is loaded with lower contacts with contacting portions extending beyond a front edge of the lower insulating member and arranged on the lower surface of the mating tongue. The assembled base portion and the lower member is received in the receiving cavity of the insulating bracket and the mating portion extends beyond a front face of the insulating bracket and surrounding by the metallic shell to define a mating cavity thereamong.

20 Claims, 12 Drawing Sheets

(51) Int. Cl.

| | |
|---|---|
| ***H01R 13/6471*** | (2011.01) |
| ***H01R 13/6585*** | (2011.01) |
| ***H01R 43/20*** | (2006.01) |
| *H01R 13/6594* | (2011.01) |

(56) References Cited

U.S. PATENT DOCUMENTS

| | | | | |
|---|---|---|---|---|
| 6,619,968 | B2 * | 9/2003 | Xu | 439/79 |
| 6,863,569 | B2 * | 3/2005 | Zhu et al. | 439/607.27 |
| 6,902,432 | B2 * | 6/2005 | Morikawa et al. | 439/607.41 |
| 6,913,485 | B2 * | 7/2005 | Ko | 439/579 |
| 7,223,915 | B2 * | 5/2007 | Hackman | 174/36 |
| 7,255,607 | B1 * | 8/2007 | Wu | 439/660 |
| 7,445,506 | B2 * | 11/2008 | Ma | 439/607.01 |
| 7,559,802 | B2 * | 7/2009 | Hu et al. | 439/607.41 |
| 7,618,293 | B2 * | 11/2009 | Wu | 439/660 |
| 7,654,866 | B2 * | 2/2010 | He et al. | 439/607.01 |
| 7,708,600 | B2 * | 5/2010 | Wu | 439/660 |
| 7,744,418 | B2 * | 6/2010 | He et al. | 439/607.35 |
| 7,744,426 | B2 * | 6/2010 | Zheng et al. | 439/660 |
| 7,824,219 | B2 * | 11/2010 | Wang | 439/607.27 |
| 7,828,598 | B2 * | 11/2010 | Wang | 439/607.27 |
| 7,837,510 | B1 * | 11/2010 | Hung et al. | 439/660 |
| 7,845,982 | B1 * | 12/2010 | Wang | 439/607.25 |
| 8,070,529 | B2 * | 12/2011 | Xiong et al. | 439/676 |
| 8,079,854 | B2 * | 12/2011 | He et al. | 439/108 |
| 8,109,795 | B2 * | 2/2012 | Lin et al. | 439/660 |
| 8,142,224 | B2 * | 3/2012 | Wu | 439/607.27 |
| 8,152,566 | B1 * | 4/2012 | Little et al. | 439/607.41 |
| 8,323,057 | B2 * | 12/2012 | Ho | 439/660 |
| 8,439,708 | B2 * | 5/2013 | Colantuono et al. | 439/660 |
| 8,475,216 | B2 * | 7/2013 | Tung et al. | 439/660 |
| 8,684,769 | B2 * | 4/2014 | Kao et al. | 439/607.28 |
| 2009/0130913 | A1 * | 5/2009 | Yi et al. | 439/676 |
| 2010/0267261 | A1 * | 10/2010 | Lin et al. | 439/218 |

* cited by examiner

ELECTRICAL CONNECTOR HAVING TERMINAL PORTIONS IN SPECIFIC ARRANGEMENT AND A GROUNDING PLATE FOR EXCELLENT HIGH-FREQUENCY CHARACTERISTICS

CROSS REFERENCE TO RELATED APPLICATIONS

This application is a continuation of U.S. patent application Ser. No. 13/479,289, filed May 24, 2012, The content of each of the above-referenced U.S. patents is incorporated by reference herein in its entirety.

FIELD OF THE INVENTION

The present invention relates generally to an electrical connector, and more particularly to an electrical connector suitable for high-speed differential signal transmission having terminal portions in specific arrangement and a grounding plate for excellent high-frequency characteristics.

DESCRIPTION OF THE RELATED ART

A connector capable of transmitting high-speed differential signals is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector is fitted to or contacted with a mating connector. On the other hand, on the terminal portion side of the contacts to be connected to a board, the terminal portions are arranged in a plurality of rows because the terminal portions are inserted into a plurality of through holes, respectively.

At present, transmission of high-speed differential signals is required in a growing number of software applications. Under the circumstances, there is a demand for an improved connector having a compact size, a low piece, and excellent high-frequency characteristics.

SUMMARY OF THE INVENTION

Accordingly, an object of the present invention is to provide an electrical connector having terminal portions in specific arrangement and a grounding plate for excellent high-frequency characteristics.

In order to achieve the object set forth, a receptacle electrical connector comprises a metallic shell, an insulating bracket defining a receiving cavity opening forward and downwards, and surrounding by the metallic shell, an upper insulating member including a base portion and a mating portion and a lower insulating member distinct from and assembled with the base portion of the upper insulating member. The mating portion defines an upper surface and a lower surface, the upper insulating member is loaded with upper contacts with contacting portions arranged on the upper surface of the mating portion and a shielding plate is located between the upper and lower surface of the upper insulating member. The lower member is loaded with lower contacts with contacting portions extending beyond a front edge of the lower insulating member and arranged on the lower surface of the mating tongue. The assembled base portion of the upper insulating member and the lower insulating member is received in the receiving cavity of the insulating bracket and the mating portion extends beyond a front face of the insulating bracket and surrounding by the metallic shell to define a mating cavity thereamong.

Other objects, advantages and novel features of the invention will become more apparent from the following detailed description of the present embodiment when taken in conjunction with the accompanying drawings.

DETAILED DESCRIPTION OF THE INVENTION

Figure 1:
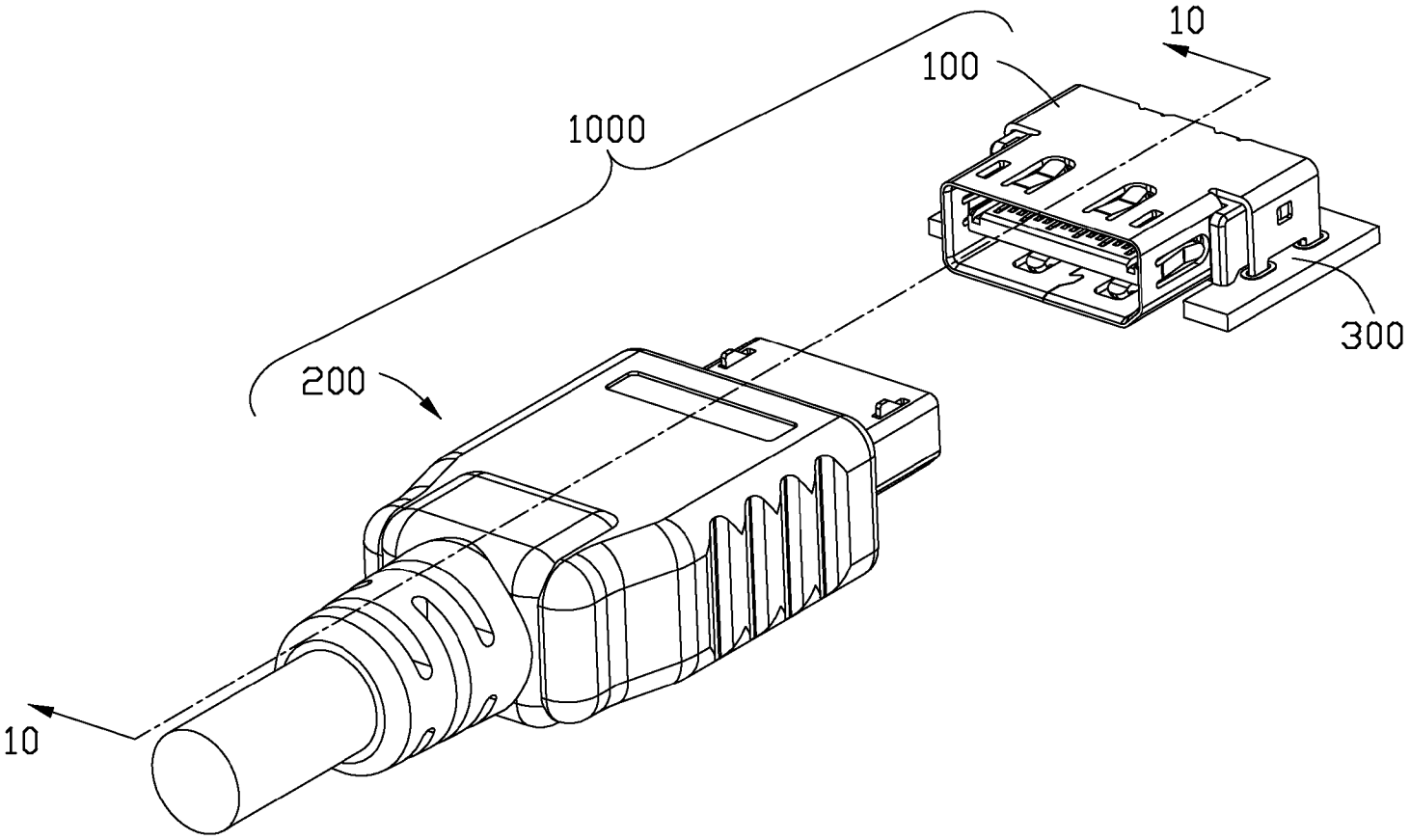
FIG. 1 is an assembled, perspective view of an electrical connector assembly including first and second connectors in accordance with the present invention.

Reference will now be made to the drawing figures to describe a preferred embodiment of the present invention in detail.

Figure 2:
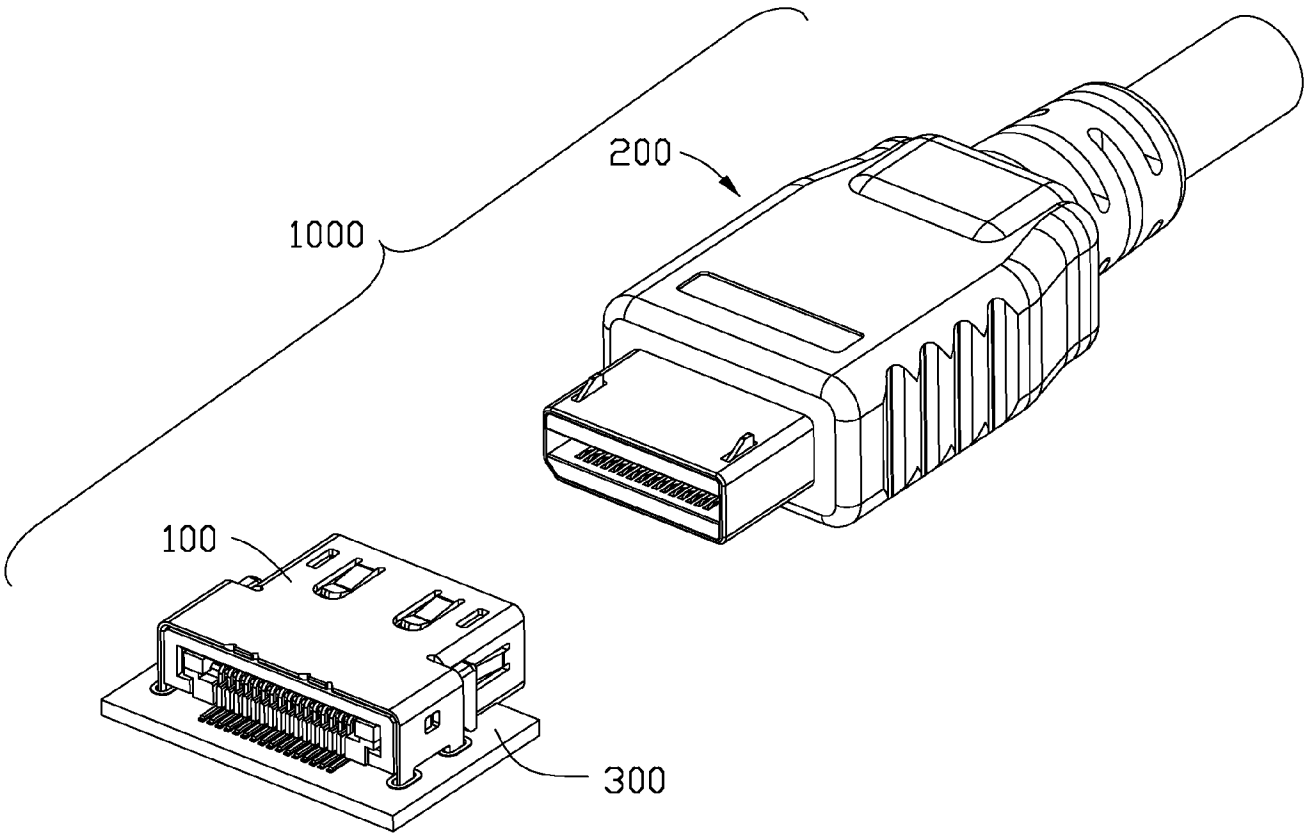
FIG. 2 is another perspective view of the electrical connector assembly shown in FIG. 1.

Referring to FIGS. 1 and 2, an electrical connector assembly 1000 in accordance with the present invention includes a first connector 100 to be mounted onto a printed circuit board 300 and a second connector 200 mating with the first connector 100.

Figure 3:
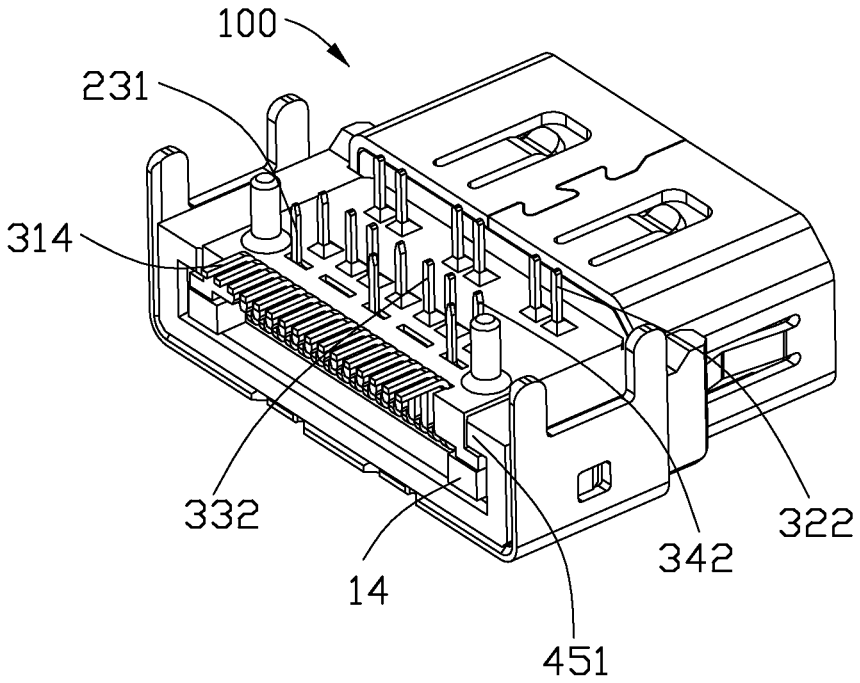
FIG. 3 is an assembled, perspective view of the first connector shown in FIG. 1.
Figure 4:
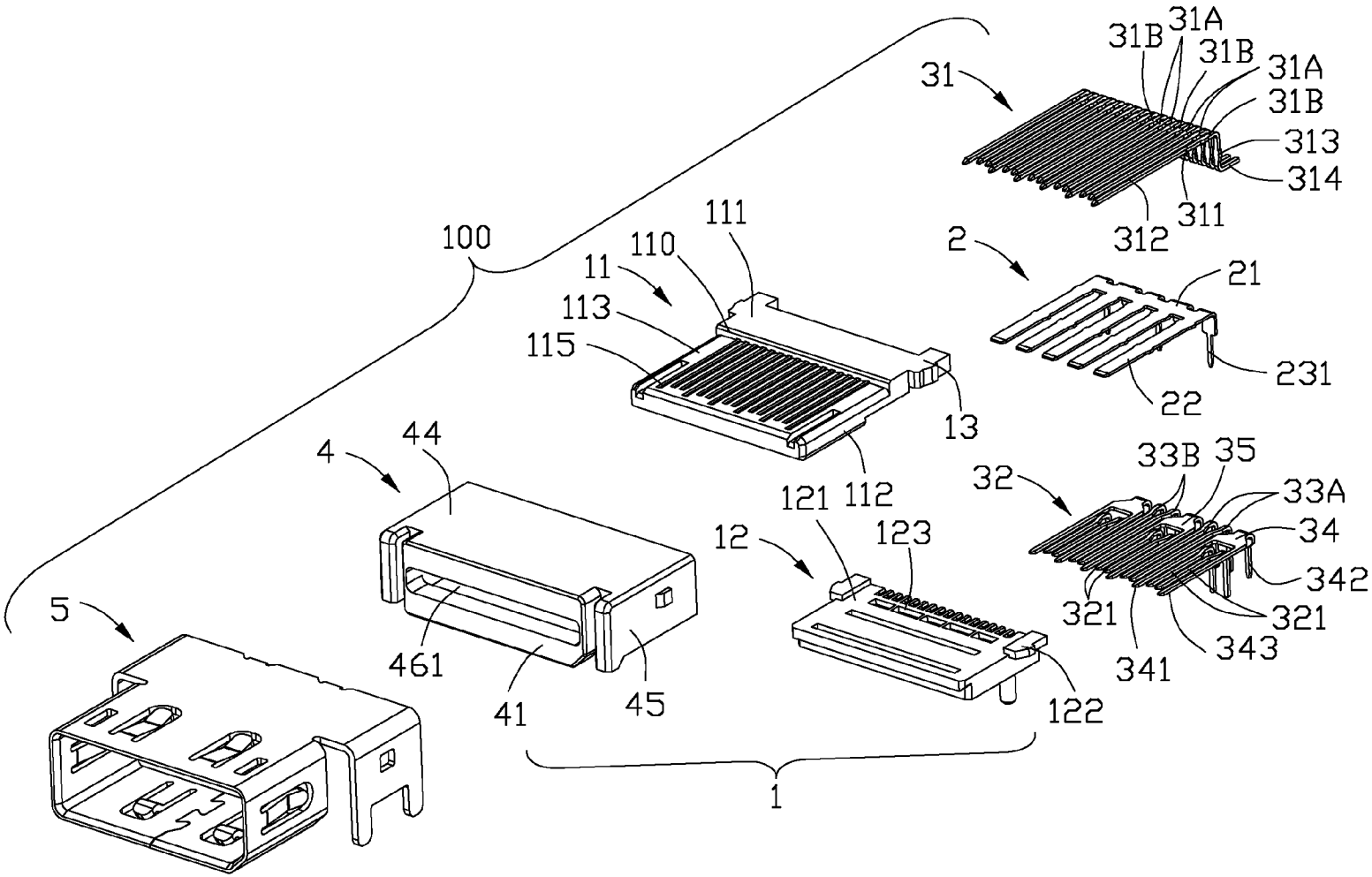
FIG. 4 is an exploded view of the first connector shown in FIG. 1.
Figure 5:
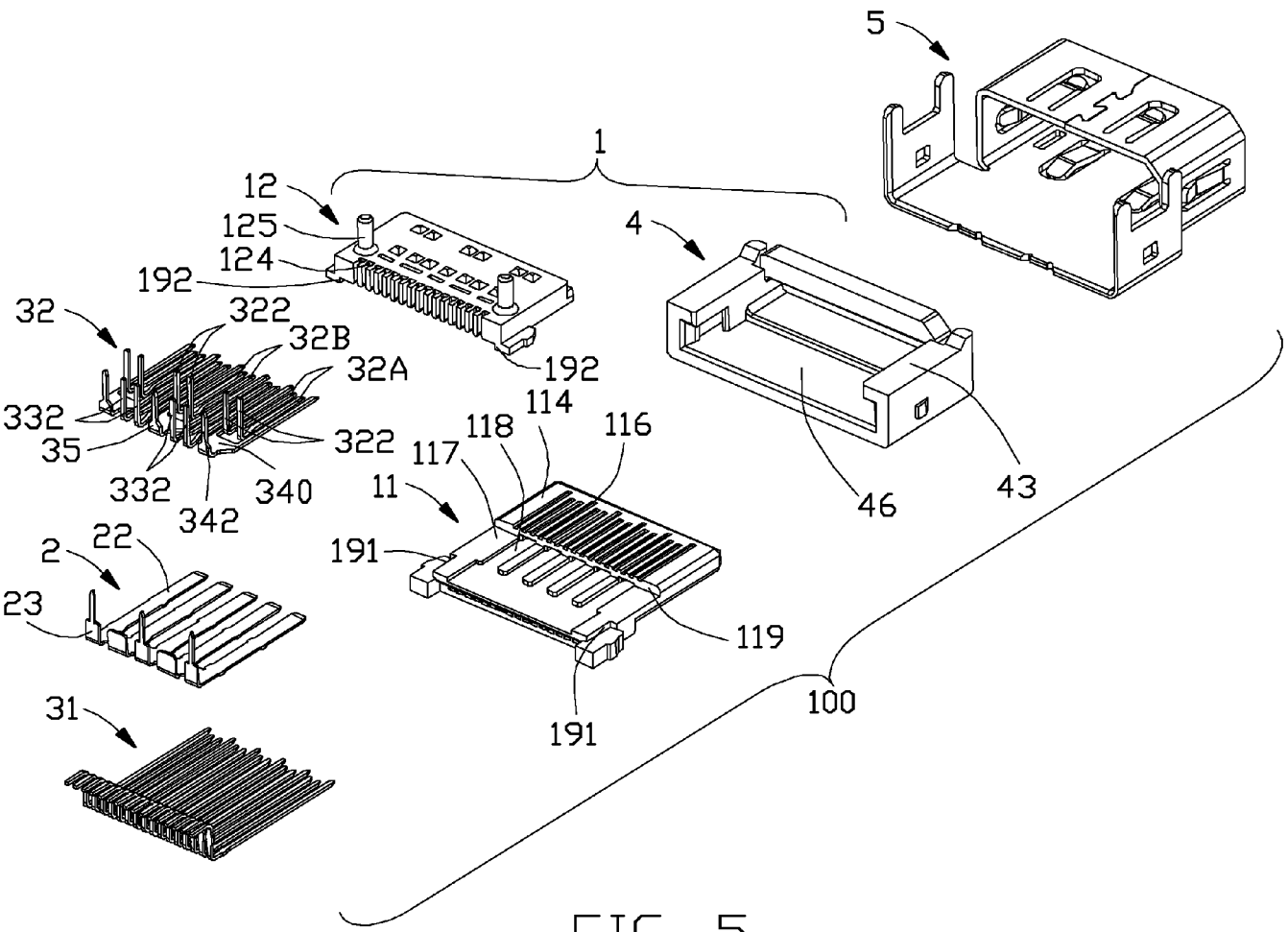
FIG. 5 is another exploded view of the first connector shown in FIG. 4.
Figure 6:
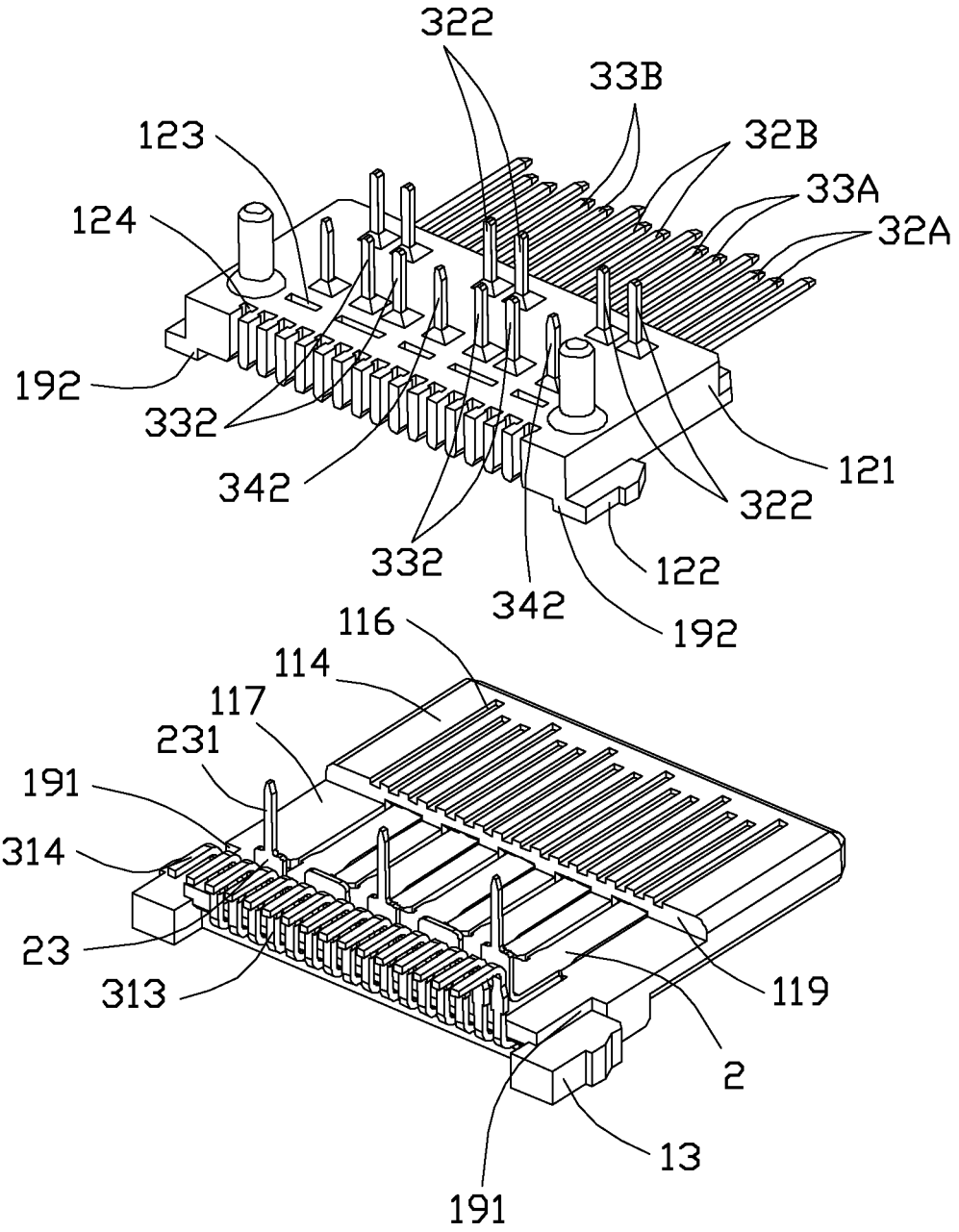
FIG. 6 is an exploded view of an upper member and a lower member of the first connector shown in FIG. 1 with a plurality of first contacts retained therein.
Figure 7:
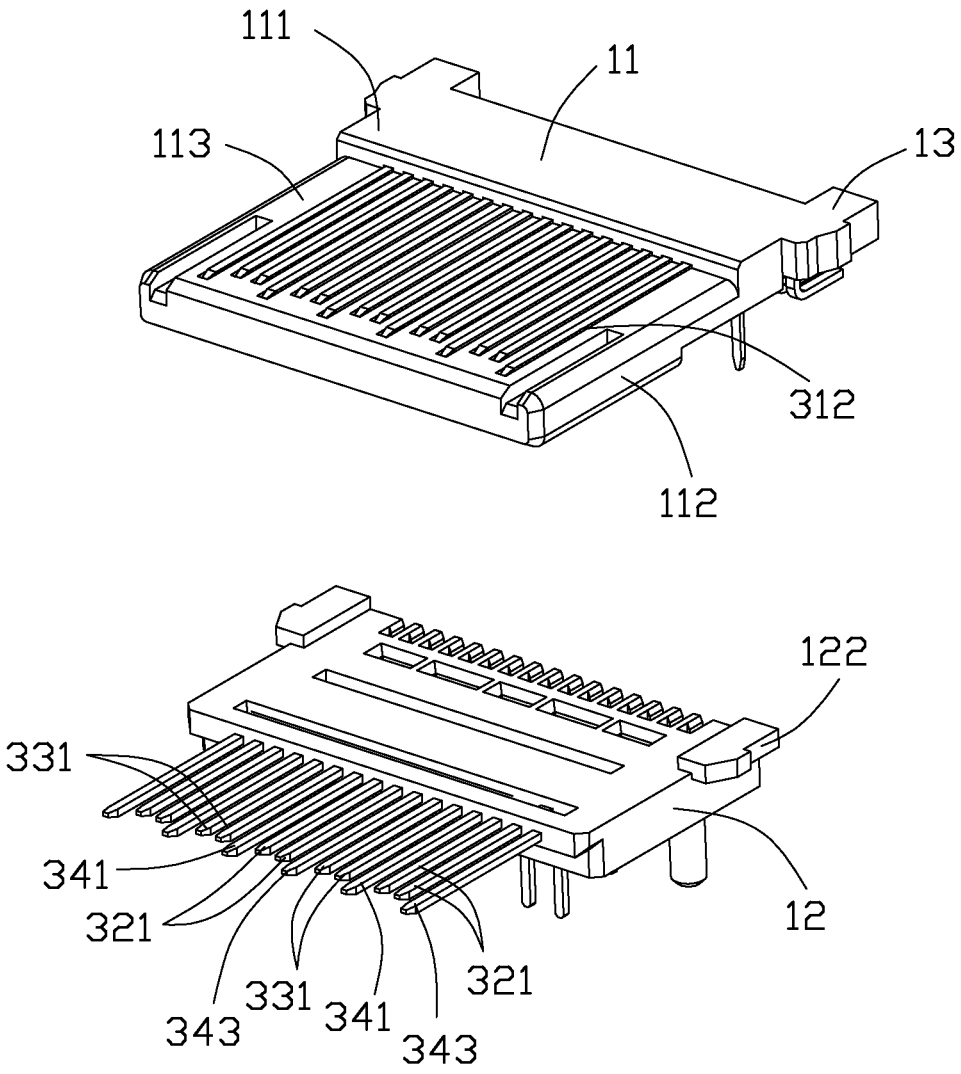
FIG. 7 is another exploded view of the upper member and the lower member shown in FIG. 6.
Figure 8:
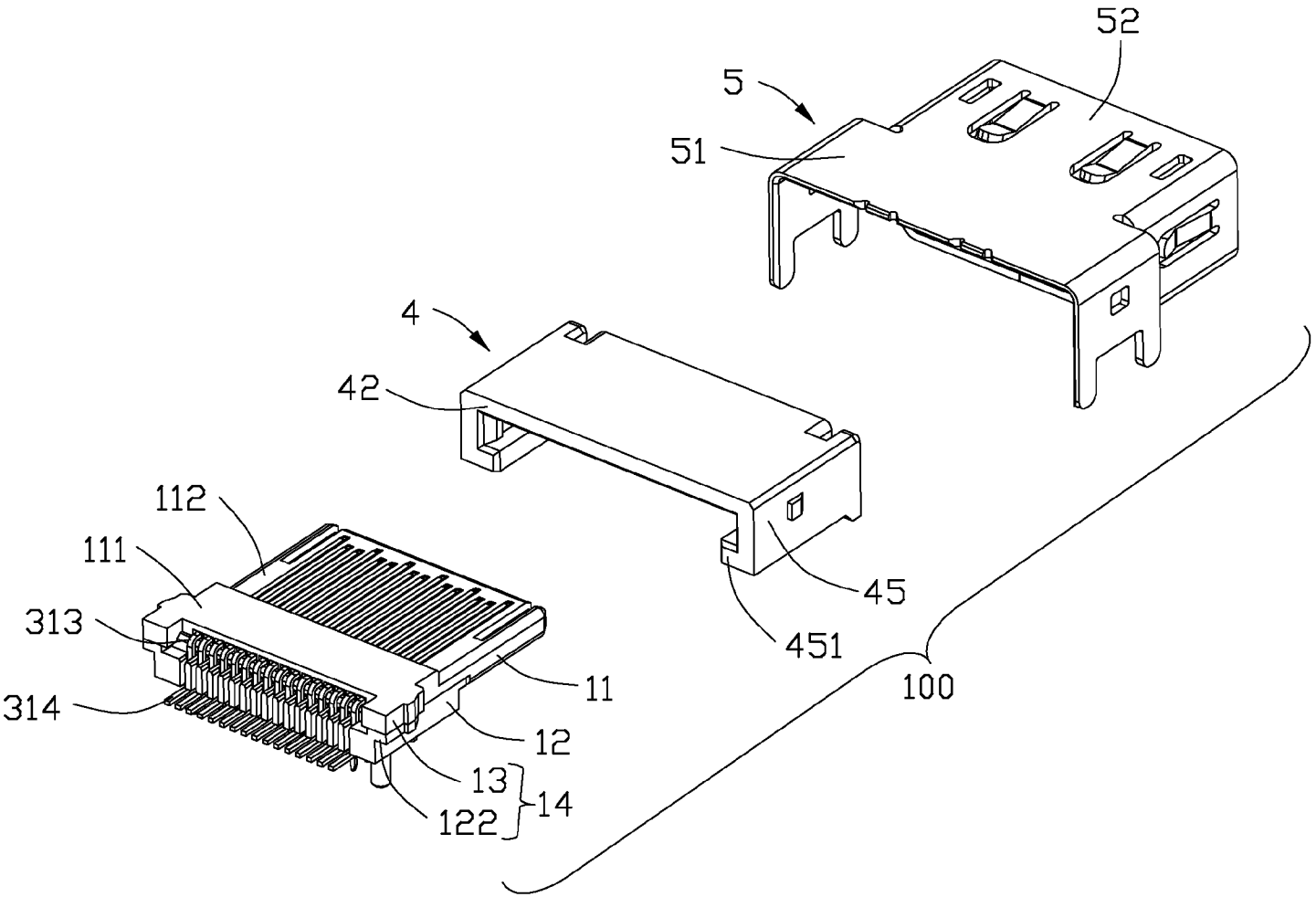
FIG. 8 is a partly exploded perspective view of the first connector and shows an insulative bracket and a metal shell separated from the upper member and the lower member shown in FIG. 1.
Figure 9:
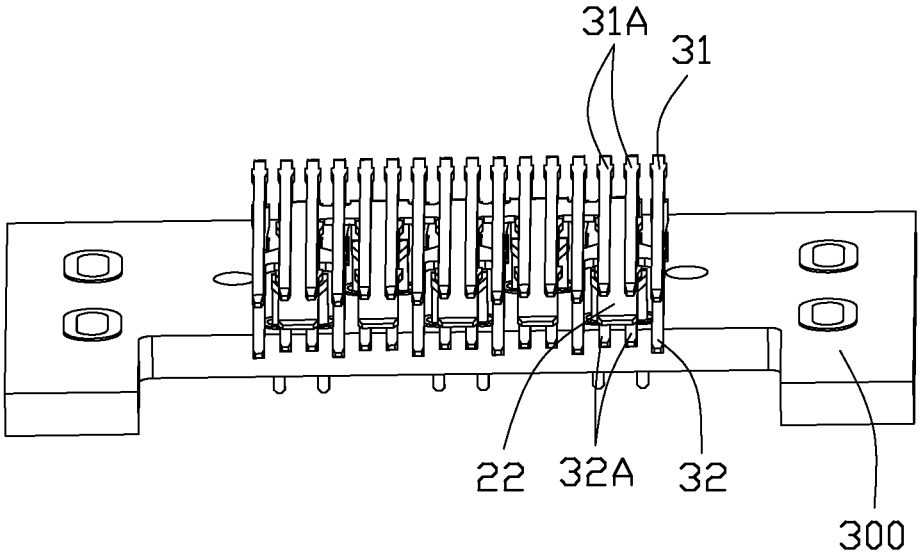
FIG. 9 is a perspective view of the first contacts and a grounding plate retained to a printed circuit board and shows arrangement of the contacting portions.

Referring to FIGS. 3 to 5, the first connector 100 mainly includes a first insulative housing 1, a first grounding/shielding plate 2 retained in the first housing 1, a plurality of first contacts retained in the first housing 1 and disposed at two opposite sides of the first grounding plate 2, and a metal shell 5 surrounding the first housing 1.

The first housing 1 includes an upper member 11, a lower member 12 engaging with the upper member 11 and an insulative bracket 4 retained to the upper and lower members 11, 12. The upper member 11 defines a first base portion 111 and a mating portion 112 extending forward from the first base portion 111 with a stopping face 110 formed therebetween, the first base portion 111 defines two protrusions 13 rearward and outwardly extending from opposite two rear sides thereof, the mating portion 112 defines opposite first mating face 113 and second mating face 114. A plurality of first receiving slots 115 is disposed upon the first mating face 113 and further run through the first base portion 111 in a mating direction, a plurality of second receiving slots 116 is disposed upon the second mating face 114 at a front portion thereof. The upper member 11 defines a receiving room/shallow recess 117 at a rear portion to be disposed behind the second receiving slots 116 and provides a step portion 119 at the mating portion 112. The receiving room 117 further defines five receiving passages 118 run into the mating portion 112 and disposed between the first mating face 113 and the second mating face 114. The upper member 11 further forms a pair of recessions 191 around two opposite rear corners to respectively receive the corresponding protrusions 192 located on two opposite rear corners of the lower insulating member 12 so as to have the lower insulating member 12 assembled to the upper insulating member 11 in the vertical direction.

The lower member 12 defines a main body portion 121 and two supporting portions 122 respectively extending outwards from two opposite sides of the main body portion 121 at an upper rear portion thereof, five through holes 123 run through the main body portion 121 in a vertical direction perpendicularly to the mating direction and arranged in a longitudinal direction. The main body portion 121 further defines a plurality of retaining slots 124 recessed from a rear face thereof and two retaining posts 125 extending downwardly from two outer sides of a bottom face thereof.

Referring to FIGS. 3 to 7, the first grounding plate 2 defines a board-shaped first base plate 21, five first shielding arms 22 extending forward from a front end of the first base plate 21, and five connecting portions 23 corresponding to the five first shielding arms 22 bending downwardly from a rear end of the first base plate 21. Three connecting legs 231 extend downwardly respectively from the first, third and fifth shielding arms 22. The five first shielding arms 22 are disposed at a same plane. The first grounding plate 2 is received in the receiving room 117 with the first shielding arms 22 forwardly inserted into the corresponding receiving passages 118 and disposed between the first and second mating faces 113, 114.

The plurality of first contacts includes a set of first upper contacts 31 and a set of first lower contacts 32. The set of first upper contacts 31 includes four pairs of upper differential pairs 31A for signal transmission and five upper grounding contacts 31B located at two opposite sides of the upper differential pairs 31A. The upper differential pairs 31A and the upper grounding contacts 31B have similar configuration and each includes an upper retention section 311, an upper blade contacting section 312 extending forward from the upper retention section 311, a restricting portion 313 bending downwardly from the upper retention section 311 and a leg section 314 bending rearwards from the restricting portion 313. The upper contacting sections 312 are disposed in a same plane, the leg sections 314 are also disposed in a same plane and arranged in one row, the leg sections 314 provide a mounting surface for mounting onto the printed circuit board 300. The set of upper contacts 31 are forwardly assembled into the first receiving slots 115 with the upper retention sections 311 retained in the upper member 11, the upper contacting sections 312 expose upon the first mating face 113, the restricting portions 313 are disposed behind the connecting portions 23.

The set of first lower contacts 32 includes four pairs of lower differential pairs 32A, 33A, 32B and 33B arranged in a longitudinal direction for signal transmission and first and second lower grounding contacts 34, 35 having similar configuration, the set of lower contacts 32 are inserted molding in the lower member 12. The first lower differential pairs 32A and the third lower differential pairs 32B have similar configuration, the second lower differential pairs 33A and the fourth lower differential pairs 33B have similar configuration. The first or third lower differential pairs 32A or 32B each defines a first terminal portion 322 and a first contacting section 321, the second or fourth lower differential pairs 33A or 33B each defines a second terminal portion 332 and a second contacting section 331. Each lower grounding contact 34/35 defines a base plate 340, a tail section 342 bending downwardly from a rear end of the base plate 340, and two grounding arms 341, 343 extending forwardly from two opposite sides of a front end of the base plate 340. The first contacting sections 321, the second contacting sections 331, and the first and second grounding arms 341, 343 are disposed in a same plane and arranged in one row with one grounding arm 341/343 disposed between every adjacent two lower differential pairs. It is noted that the terminal portions 322, 332 extending downwardly and vertically with an upper section embedded within the lower insulating member 12.

In this embodiment, the two first contacting sections 321 of the first lower differential pairs 32A and the two second contacting sections 331 of the second lower differential pairs 33A are respectively disposed at two opposite sides of a first grounding arm 341 of the first lower grounding contact 34, the two first contacting sections 321 of the third lower differential pairs 32B and the two second contacting sections 331 of the second lower differential pairs 33A are respectively disposed at two opposite sides of a second grounding arm 343 of the second grounding contact 35, the two first contacting sections 321 of the third lower differential pairs 32B and the two second contacting sections 331 of the fourth lower differential pairs 33B are respectively disposed at two opposite sides of a first grounding arm 341 of the second grounding contact 35. The first and second grounding arms 341, 343 of the first lower grounding contact 34 are disposed at two outmost of the first contacting sections 321 of the first lower differential pairs 32A, and the first and second grounding arms 341, 343 of the second lower grounding contact 35 are disposed at two outmost of the first contacting sections 321 of the third lower differential pairs 32B. The first terminal portions 322, the second terminal portions 332, and the tail sections 342 are arranged in two rows under a condition that the first terminal portions 322 of the first and third lower differential pairs 32A, 32B are arranged in a first row, and the second terminal portions 332 of the second and fourth lower differential pairs 33A, 33B and the tail sections 342 of the first and second lower grounding contacts 34, 35 are arranged in a second row. The tail sections 342 of the first and second grounding contacts 34, 35 are disposed at two outmost of the second terminal portions 332 of the second lower differential pairs 33A. The first and second terminal portions 322, 332 and the tail sections 342 in specific arrangement may provide excellent high-frequency characteristics of the first connector 100.

Referring to FIGS. 6 to 10, the lower member 12 retaining the set of lower contacts 32 is upwardly assembled to the upper member 11. The main body portion 121 is received in the receiving room 117 and abuts against the step portion 119, and the supporting portions 122 upwardly abut against the protrusions 13 to be defined as hooking portions 14. The first contacting sections 321, the second contacting sections 331, and the first and second grounding arms 341, 343 are received in corresponding second receiving slots 116 and expose upon the second mating face 114. The connecting portions 23 are received in the through holes 123 with the connecting legs 231 running therethrough, the restricting portions 313 retained in the retaining slots 124, and the leg sections 314 located behind the connecting legs 231 and arranged in a third row. The first grounding plate 2 is disposed between the set of first upper contacts 31 and the set of first lower contacts 32 with each first shielding arm 22 disposed between a upper differential pairs 31A of the first upper contacts 31 and a lower differential pairs 32A, 33A, 32B or 33B of the first lower contacts 32 for improved impedance.

Referring to FIG. 3 to FIG. 10, the bracket 4 defines a front face 41, a rear face 42 opposite to the front face 41, a bottom face 43 defined as a fixing face, a top face 44 facing to the bottom face 43, and a pair of sidewalls 45 connecting with the bottom and top faces 43, 44. A receiving portion 46 is recessed rearwards from the front face 411 to run through the rear face 42 and a rear portion of the bottom face 43, and the receiving portion 46 provides an opening 461 at the front face 41 thereof. The sidewalls 45 each defines a platform 451 extending towards the receiving portion 46 from an inner face of the sidewall 45. The upper member 11 assembled with the lower member 12 is inserted into the receiving portion 46 from the rear face 42 of the bracket 4 and retained in the receiving portion 46 by the hooking portions 14 supported by the corresponding platforms 451 and locking with the sidewalls 45. The mating portion 112 forwardly extends out of the receiving portion 46 from the opening 461 thereof. The first base portion 111 retaining with the main body portion 121 and the bracket 4 is defined as a base member 15 of the first connector 100, and the mating portion 112 is defined as a mating member 16 of the first connector 100.

The metal shell 5 defines a shielding portion 51 surrounding the bracket 4, and a mating frame 52 connecting with the shielding portion 51. The shell 5 is assembled rearwards from the front face 41 of the bracket 4, the shielding portion 51 surrounds the bracket 4, and the mating member 16 is disposed in the mating frame 52.

Figure 10:
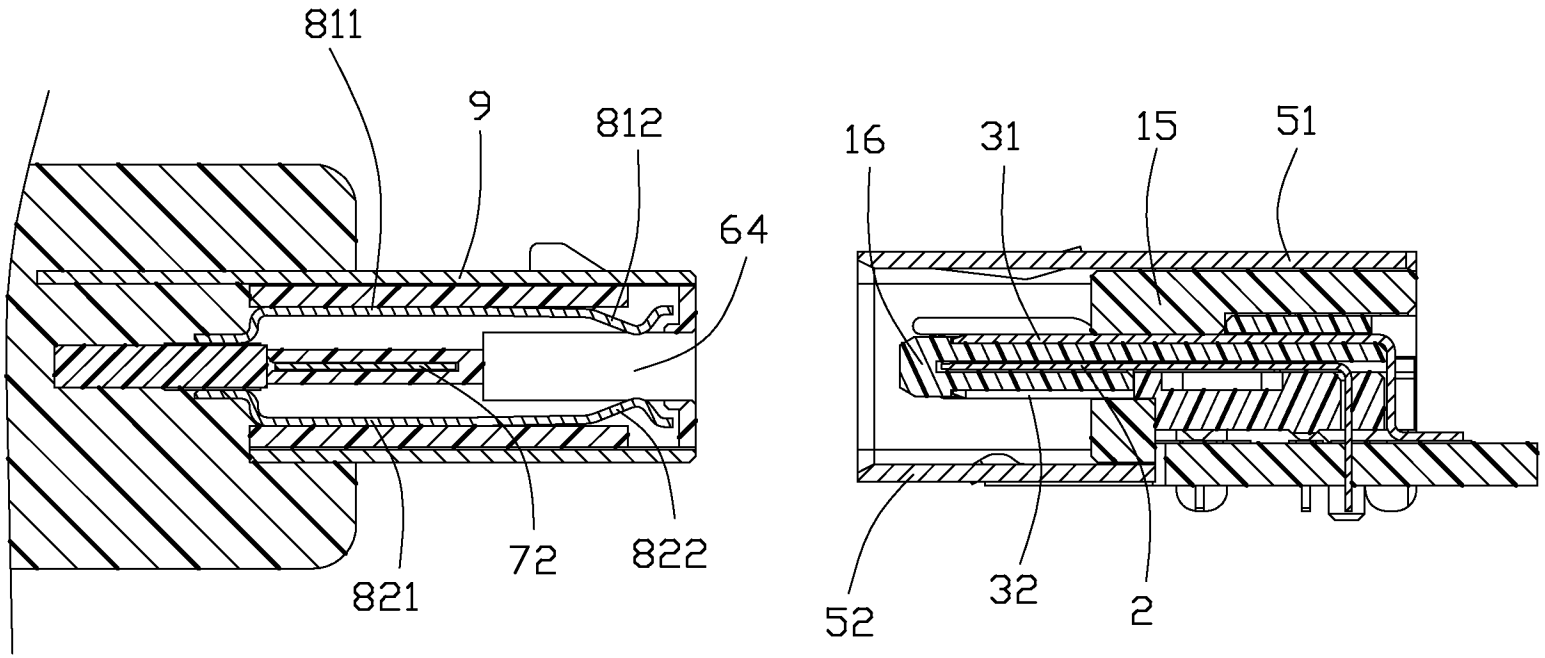
FIG. 10 is a cross-section view of the electrical connector assembly taken along line 10-10 of FIG. 1.
Figure 11:
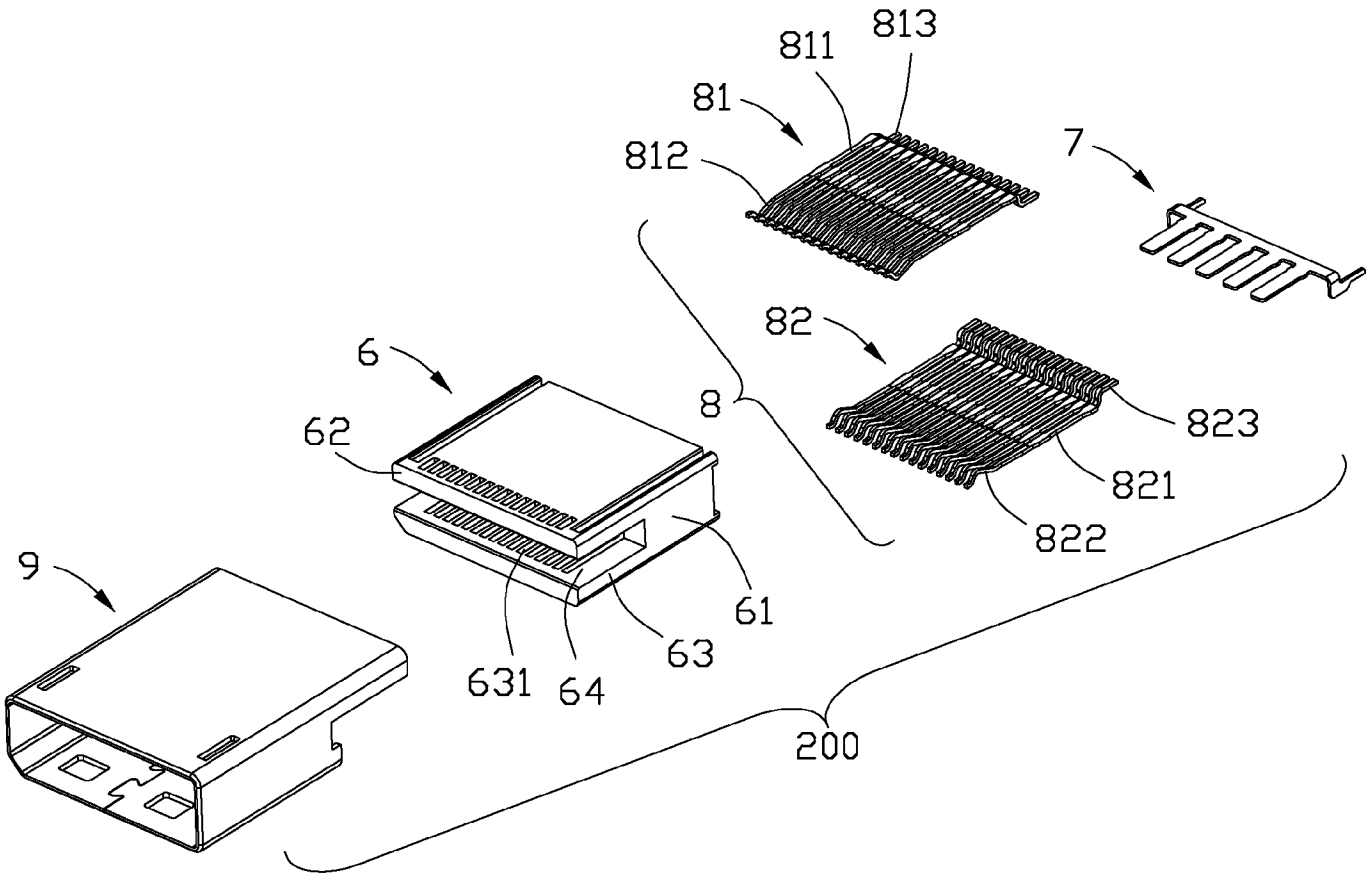
FIG. 11 is an exploded perspective view of the second connector shown in FIG. 1.
Figure 12:
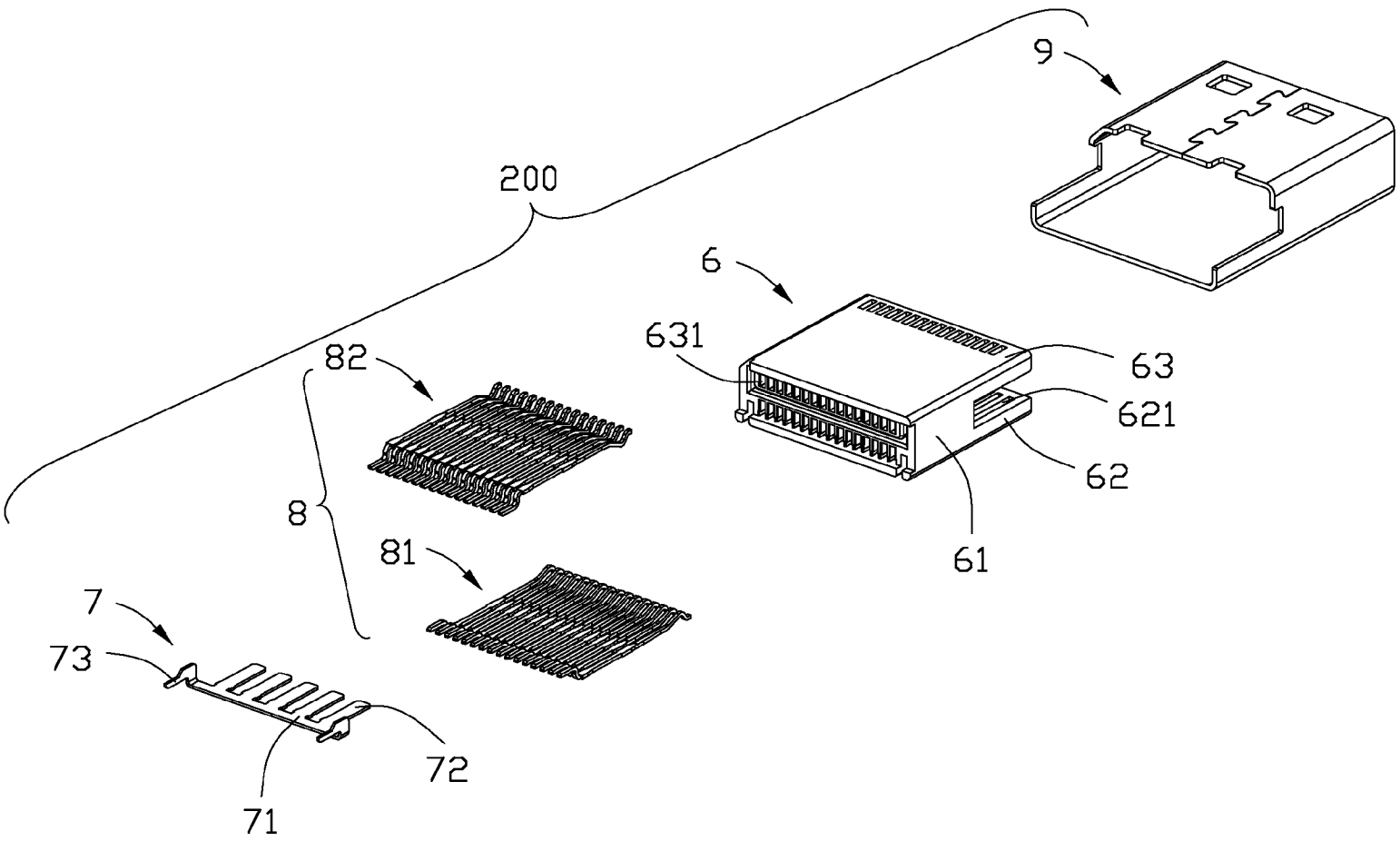
FIG. 12 is another exploded perspective view of the second connector shown in FIG. 11.

Referring to FIG. 10 to FIG. 12, the second connector 200 mainly includes a second insulative housing 6, a second grounding plate 7 retained to the second housing 6, a plurality of second contacts 8 retained to the second housing 6, and a second metal shell 9 shielding the second housing 6.

The second housing 6 defines a second base portion 61, a first tongue portion 62 and a second tongue portion 63 oppositely extending forward from the second base portion 61, and a mating room 64 disposed between the first and second tongue portions 62, 63. The first tongue portion 62 defines a plurality of first receiving grooves 621 communicating with the mating room 64 and further run through the second base portion 61, the second tongue portion 63 defines a plurality of second receiving grooves 631 communicating with the mating room 64 and further run through the second base portion 61.

The second grounding plate 7 defines a second base plate 71, five second shielding arms 72 extending forward from a front end of the second base plate 71, and two soldering portions 73 bending downwardly and extending rearwards from two sides of the second base plate 71. The five second shielding arms 72 is disposed at a same plane. The second grounding plate 7 is insert-molded in the second housing 6 with the soldering portions 73 extending out of the second housing 6.

The plurality of second contacts 8 includes a set of second upper contacts 81 and a set of second lower contacts 82. Each second upper contact defines a first fixing portion 811, a first flexible contacting arm 812 extending forward from the first fixing portion 811 and bending downwardly, and an upper soldering leg 813 bending downwardly and then extending rearward from the first fixing portion 811. Each second lower contacts 82 defines a second fixing portion 821, a second flexible contacting arm 822 extending forward from the second fixing portion 821 and bending upwardly, and a lower soldering leg 823 bending upwardly and then extending rearward from the second fixing portion 821. The plurality of second contacts 8 are assembled to the second housing 6 with the set of second upper contacts 81 retained in the first receiving grooves 621, and the set of second lower contacts 82 retained in the second receiving grooves 631. The first flexible contacting arms 812 and second flexible contacting arms 822 partly project into the mating room 64, the second shielding arms 72 are disposed between the first fixing portions 811 and the second fixing portions 821 for improved impedance. The second shell 9 covers outside of the second housing 6 for shielding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle electrical connector comprising:

a metallic shell;

an upper insulating member including a base portion and a mating portion, the mating portion defining an upper surface and a lower surface, the upper insulating member being loaded with upper contacts having contacting portions arranged on the upper surface of the mating portion and a metallic shielding plate located between the upper and lower surface of the upper insulating member;

a lower insulating member discrete from and assembled with the base portion of the upper insulating member, the lower insulating member loaded with lower contacts with contacting portions extending beyond a front edge of the lower insulating member and arranged on the lower surface of the mating portion; and means for assembling the lower insulating member to the upper insulating member only along a vertical direction;

wherein the assembled base portion of the upper insulating member and the lower insulating member are received in the metallic shell, wherein the lower contacts are insert-molded within the lower insulating member; wherein each of said lower contacts further includes a vertically extending terminal portion located behind the contacting portion while in front of a rear edge of the lower insulating member with thereof an upper section securely embedded within the lower insulating member.

2. The receptacle electrical connector as described in claim 1, wherein the base portion of the upper insulating member defines a shallow recess at the lower surface thereof, the lower insulating member is received in the shallow recess.

3. The receptacle electrical connector as described in claim 2, wherein the shielding plate comprises a front portion loaded in the mating tongue and a rear portion exposed to the shallow recess and sandwiched by the lower insulating member.

4. The receptacle electrical connector as described in claim 3, wherein the shielding plate defines a plurality of connecting portion bending downwards and inserted into corresponding through holes defined in the lower insulating member.

5. The receptacle electrical connector as described in claim 1, further including an insulating bracket disposed in the shell, wherein said insulating bracket defines a receiving cavity through which said mating portion forwardly extends, and wherein the insulating bracket is opened rearwards and the assembled upper insulating member and the lower insulating member is assembled to the insulating bracket in a rear-to-front direction.

6. An assembling method of a receptacle electrical connector, comprising:

providing an upper insulating member, the upper insulating member defining an upper surface and a lower surface, the upper insulating member being loaded with a plurality of upper contacts arranged on the upper surface of the upper insulating member and a shielding plate located between the upper surface and the lower surface of the upper insulating member;

providing a lower insulating member discrete from the upper insulating member, the lower insulating member being loaded with a plurality of lower contacts;

assembling the upper and lower insulating members together intimately in a vertical direction; and providing a metallic shell surrounding the assembled upper and lower insulating member to define a mating cavity; wherein each of said lower contacts includes a front contacting portion extending beyond a front edge of the lower insulating member and exposed upon the lower surface of the upper insulating member.

7. The assembling method of the receptacle electrical connector as described in claim 6, wherein an insulating bracket is provided to define a receiving cavity, the assembled the upper and lower insulating members is received in the receiving cavity with a front portion of the assembled the upper and lower insulating members extending beyond the insulating bracket to be functioned as a mating member.

8. The assembling method of the receptacle electrical connector as described in claim 6, wherein the upper insulating member comprises a rear base portion and a front portion, the upper contacts comprise contacting portions exposed to an upper surface of the front portion and the lower contacts comprise said contacting portions from the lower insulating member and exposed to a lower surface of the front portion thereby the front portion being functioned as said mating member.

9. The assembling method as described in claim 8, wherein the rear base defines a shallow recess to receive the lower insulating member.

10. An electrical connector assembly comprising:

an upper insulating member including a base portion and a tongue like mating portion extending forwardly therefrom, said mating portion defining opposite upper and lower surfaces thereon, a plurality of upper contacts retained by said upper insulating member with corresponding contacting sections exposed upon the upper surface;

a metallic grounding plate horizontally extending and embedded within the mating portion;

a lower insulating member located and assembled under the upper insulating member; and a plurality of lower contacts retained by said lower insulating member with corresponding contacting sections exposed upon the lower surface, each of the lower contacts defining a horizontal contacting section and a vertical tail section, said lower contacting being categorized with at least one differential pair with a grounding contact beside; wherein a distance between the two contacting sections of the differential pair in a transverse direction is smaller than that between the two vertical tail sections of said differential pair in the transverse direction, and the vertical tail sections of the differential pair are aligned with each other in a first row in the transverse direction while the vertical tail section of the neighboring grounding contact is located in a second row in said transverse direction rearwardly spaced from the first row.

11. The electrical connector assembly as claimed in claim 10, further including an insulative bracket defining a through opening forwardly communicating with an exterior in a front-to-back direction, wherein said mating portion extends through said through opening.

12. The electrical connector assembly as claimed in claim 10, wherein the grounding plate includes a plurality of downwardly extending mounting legs regulated by said lower insulating member.

13. The electrical connector assembly as claimed in claim 10, wherein tail sections of the upper contacts are regulated by the lower insulating member.

14. The electrical connector assembly as claimed in claim 10, wherein both said upper insulating member and said lower insulating member are equipped with lateral protrusions for reception within the housing.

15. The electrical connector assembly as claimed in claim 10, further including a metallic shell enclosing the housing to define a mating cavity surrounding said mating portion.

16. The electrical connector assembly as claimed in claim 10, wherein the mating portion unitarily extends forwardly from the base portion.

17. The electrical connector assembly as claimed in claim 10, wherein two grounding contacts respectively located by two sides of said differential pair share the same one vertical tail section.

18. The receptacle electrical connector as described in claim 1, wherein the lower insulating member is intimately stacked with the upper insulating member in the vertical direction.

19. The receptacle electrical connector as described in claim 1, wherein the lower insulating member forms a plurality of retaining slots in the rear edge to receive terminal portions of the corresponding upper contacts, respectively.

20. The assembling method as described in claim 6, wherein the lower contacts are insert-molded within the lower insulating member, each of the lower contacts further includes a vertically extending terminal portion located behind the contacting portion while in front of a rear edge of the lower insulating member so as to have an upper section of the terminal portion securely embedded within the lower insulating member.

* * * * *